US011505448B2

(12) United States Patent
Schulz-Hildebrandt et al.

(10) Patent No.: US 11,505,448 B2
(45) Date of Patent: Nov. 22, 2022

(54) DEVICE FOR DISCHARGING AND RETURNING FLUIDS

(71) Applicant: ELAFLEX HIBY GmbH & Co. KG, Hamburg (DE)

(72) Inventors: Lasse Schulz-Hildebrandt, Neumünster (DE); Matthias Fedde, Hamburg (DE)

(73) Assignee: ELAFLEX HIBY GmbH & Co. KG, Hamburg (DE)

( * ) Notice: Subject to any disclaimer, the term of this patent is extended or adjusted under 35 U.S.C. 154(b) by 0 days.

(21) Appl. No.: 17/289,879

(22) PCT Filed: Oct. 28, 2019

(86) PCT No.: PCT/EP2019/079382
§ 371 (c)(1),
(2) Date: Nov. 18, 2021

(87) PCT Pub. No.: WO2020/089161
PCT Pub. Date: May 7, 2020

(65) Prior Publication Data

US 2022/0204336 A1 Jun. 30, 2022

(30) Foreign Application Priority Data

Oct. 30, 2018 (EP) ..... 18203262

(51) Int. Cl.
*B67D 7/54* (2010.01)
*B67D 7/04* (2010.01)

(52) U.S. Cl.
CPC ..... *B67D 7/54* (2013.01); *B67D 7/0486* (2013.01); *B67D 2007/545* (2013.01)

(58) Field of Classification Search
CPC .. B67D 7/54; B67D 7/0486; B67D 2007/545; B67D 7/0478
See application file for complete search history.

(56) References Cited

U.S. PATENT DOCUMENTS 5,669,361 A 9/1997 Weissinger
6,095,204 A 8/2000 Healy
(Continued)

FOREIGN PATENT DOCUMENTS

CH 600221 A5 6/1978
CN 1432724 A 7/2003
(Continued)

OTHER PUBLICATIONS

International Search Report and Written Opinion, International Patent Application No. PCT/EP2019/079382, dated Feb. 12, 2020, 2 pages.

*Primary Examiner* — Jason K Niesz
(74) *Attorney, Agent, or Firm* — Casimir Jones, S.C.; Brian F. Bradley

(57) ABSTRACT

The invention relates to a device for discharging a first fluid and for returning a second fluid, comprising a main channel (13) for discharging the first fluid and a return channel (14) for returning the second fluid. According to the invention, a test channel (15) is provided which connects the main channel (13) to the return channel (14), the main channel (13) having a narrowing (16) and the test channel (15) issuing into the main channel (13) in the region of the narrowing (16). The device further has a sensor (17) which is designed to determine a pressure in the test channel (15). The invention further relates to an outflow tube, a delivery nozzle and a delivery pump having a device according to the invention. With the aid of the invention, active return of the second fluid can be shut off in a simple and safe manner.

20 Claims, 5 Drawing Sheets

(56) References Cited

U.S. PATENT DOCUMENTS

Figure 1A:
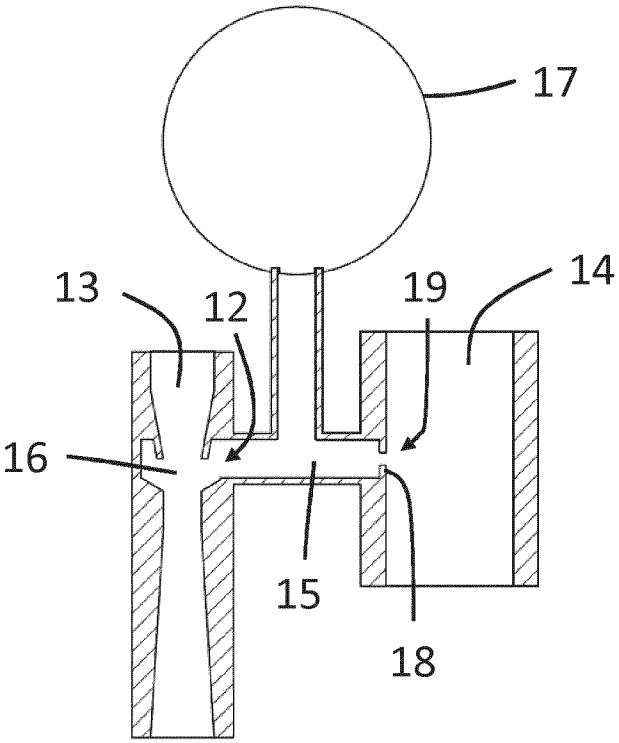

| | | | | |
|---|---|---|---|---|
| 6,102,085 | A * | 8/2000 | Nanaji | B67D 7/0478 141/59 |
| 9,604,837 | B2 | 3/2017 | Brown | |
| 2002/0056487 | A1* | 5/2002 | Pope | B67D 7/0478 141/59 |
| 2003/0131832 | A1 | 7/2003 | Matsumoto | |
| 2013/0180600 | A1 | 7/2013 | Brown et al. | |
| 2016/0061124 | A1 | 3/2016 | Pflug | |

FOREIGN PATENT DOCUMENTS

| | | | |
|---|---|---|---|
| CN | 102869575 | A | 1/2013 |
| CN | 106194510 | A | 12/2016 |
| GB | 2016417 | | 9/1979 |
| WO | WO2011049910 | A1 | 4/2011 |
| WO | WO 2012/138623 | A1 | 10/2012 |

* cited by examiner

DEVICE FOR DISCHARGING AND RETURNING FLUIDS

The subject of the present invention is a device for discharging a first fluid and for returning a second fluid, comprising a main channel for discharging the first fluid and a return channel for returning the second fluid.

Such devices are used, for example, when refueling vehicles. In this case, a delivery nozzle is inserted into a filler neck of the vehicle and the fuel is subsequently dispensed into a tank of the vehicle. During this process, fuel vapors which are already located in the tank are displaced therefrom. So that the fuel vapors do not escape into the environment, it is known in the prior art to suction off the vapors via a return channel and to pass the vapors, for example, to an underground fuel reservoir. Such a procedure is also called "active return" hereinafter.

An alternative solution for avoiding the escape of fuel vapors is to provide the vehicle itself with a system for collecting fuel vapors. Such systems are also called "onboard refueling vapor recovery" systems (systems for the recovery of refueling vapors on the vehicle side, hereinafter also called ORVR systems). In a vehicle with such an ORVR system, the displaced fuel vapors are collected inside the vehicle and supplied, for example, to an activated charcoal canister for separation.

If a vehicle provided with an ORVR system is refueled by a nozzle system with active return, the active return has to be shut off, since all of the fuel vapors or at least a large portion of the fuel vapors have already been removed by the ORVR system and an additional active return would substantially suction in external air and pass this external air into the fuel reservoir. This has to be avoided at all costs since the suctioned air is mixed with the gas vapors in the fuel reservoir and would cause an increase in pressure. For physical reasons, a substantially greater volume of the air-gas vapor mixture would escape via the venting system of the fuel reservoir, compared to the air volume introduced, which has a detrimental effect both on the environment and on the cost efficiency.

In order to ensure such a shut-off of the active return, it is known in the prior art to provide the delivery nozzle with a sensor which identifies whether the vehicle to be refueled has an ORVR system or not (see for example US 2013/0180600 A1 or WO 2012/138623 A1). For example, it is known to provide the outflow tube of the delivery nozzle with a folding bellows which ensures an airtight seal around the filler neck. If a vehicle provided with an ORVR system is now refueled with such a delivery nozzle, the airtight seal leads to a negative pressure which results in the active return being shut off.

A drawback of these known systems is their unreliability and their complex structural design. In particular, with an oblique positioning of the delivery nozzle an insufficiently airtight seal is frequently produced by the folding bellows so that the active return is not able to be reliably shut off.

Moreover, a control valve is disclosed in CH 600 221 A5 which keeps the flowrate of a fluid in a first line proportional to the flowrate of a fluid in a second line, by a pressure difference generated by the flow of the fluid through the first line being utilized for switching a valve located in the second line. However, this control valve is not suitable for solving the aforementioned problem of permitting the active return to be shut off.

Against this background, it is the object of the present invention to provide a device for discharging a first fluid and for returning a second fluid which permits with a simple constructional design a reliable shut-off of an active return of the second fluid. This object is achieved by the features of the independent claims. Advantageous embodiments are specified in the subclaims. The device according to the invention has a test channel which connects the main channel to the return channel, wherein the main channel has a narrowing and the test channel issues into the main channel in the region of the narrowing, wherein the device further has a sensor which is designed to determine a pressure in the test channel.

Firstly some of the terms used within the context of the invention are explained. The term "fluid" denotes a liquid or gaseous medium within the context of the invention. The first fluid may be, in particular, a fuel, the second fluid may be, for example, fuel vapors, air or a mixture of fuel vapors and air.

The device according to the invention comprises a main channel for discharging the first fluid and a return channel for returning the second fluid. A discharge and return may be carried out by connecting a corresponding discharge pump and/or a corresponding return pump to the respective channel. Within the context of the invention it is not necessary that the device according to the invention comprises these pumps.

The term "sensor for determining a pressure" is to be understood broadly within the context of the invention. It is possible but not absolutely necessary that the sensor is designed to specify a numerical value of the pressure prevailing in the test channel. It may be provided that the pressure sensor is designed to detect when a pressure threshold value has been exceeded and/or fallen below.

When the first fluid is discharged, this first fluid flows through the main channel of the device according to the invention. Based on Bernoulli's flow laws, it leads to a drop in hydrostatic pressure in the region of the narrowing of the main channel, whereby a negative pressure is generated in the test channel where the test channel feeds into the main channel. This effect is also denoted as the "Venturi effect". By means of the negative pressure the second fluid is suctioned from the return channel into the test channel.

Within the context of the invention, use is also made of the fact that when the second fluid passes from the return channel into the test channel a pressure drops downstream of a feed opening of the test channel, the amount thereof depending on the physical material properties (for example the density and/or the viscosity) of the second fluid. The effect that a specific pressure difference drops after passing through an opening or after passing a local flow resistance, the level of said pressure depending on the physical material properties of the fluid, is known in principle and is used, for example, in so-called "metering orifices" or "throttles". The invention makes use of this effect by the pressure in the test channel being determined by means of the sensor according to the invention. Thus conclusions may be drawn from the measured pressure, for example, relative to the mass density and/or the viscosity of the fluid flowing through the test channel. Since, in particular, fuel vapors have different physical material properties relative to air, in this manner a differentiation may be made as to whether the suctioned second fluid is fuel vapors or air. Within the context of the invention, therefore, the clear difference between the density of air (approximately 1.2 $kg/m^3$ at room temperature and at normal pressure) and the density of fuel vapors (approximately 3.4 $kg/m^3$ at room temperature and at normal pressure) and/or the difference between the viscosity of air (approximately 18 μPa*s at room temperature and normal pressure) and the viscosity of fuel vapors (approximately 7-12 μPa*s at room temperature and normal pressure) may be utilized. Depending on the measured pressure value, therefore, it is possible to make a decision as to whether an active return of the second fluid is required or not. Relative to the prior art there is the particular advantage that a folding bellows, by which an airtight closure is produced relative to a tank, is not required, so that the device according to the invention is structurally more simple and at the same time operates in a significantly more reliable manner.

In a preferred embodiment, the test channel has a orifice. An orifice denotes within the context of the invention an object which limits the flow cross section available in the channel. The orifice may also be denoted as the local flow resistance. For example, the orifice may be of annular configuration and have a circular through-passage region in the center of the orifice. A greater pressure difference may be generated by the use of an orifice, so that determining the pressure in the test channel is simplified. The sensor is preferably arranged downstream of the orifice (viewed from the return channel). The orifice may be arranged, particular, in the region of the test channel which feeds into the return channel.

Preferably the main channel is designed to pass a substantially constant volumetric flow through the narrowing. A constant volumetric flow through the narrowing has the advantage that the suction power generated by the Venturi effect is also substantially constant. Since the suction power affects the pressure in the test channel, at constant suction power the assignment of a determined pressure value to a mass density of the suctioned fluid is simplified. The volumetric flow through the narrowing is preferably between 2 l/min and 20 l/min, further preferably between 5 l/min and 15 l/min and even further preferably between 8 l/m and 12 l/min. Based on the Venturi effect the aforementioned volumetric flows lead to an adequate suction power so that a pressure value in the test channel may be reliably determined. For example, a discharge pump arranged upstream of the narrowing (relative to a throughflow direction of the main channel) may be designed to dispense a substantially constant volumetric flow through the main channel.

However, it may occasionally be desired to vary the volumetric flow through the main channel in order to permit a more flexible discharge of the first fluid. In an advantageous embodiment, therefore, the main channel has a bypass channel bridging the narrowing. The term "bridging" in this case is understood to mean that the bypass channel branches off from the main channel upstream of the narrowing (relative to the flow direction) and feeds back into the main channel downstream of the narrowing. This embodiment is advantageous, in particular, if the first fluid is to be passed through the main channel at a variable volumetric flow, but the volumetric flow is to remain constant through the narrowing. By means of the bypass channel according to the invention the volumetric flow may optionally be guided past the narrowing so that the volumetric flow may be kept constant through the narrowing. To this end, the device according to the invention may also have a bypass valve which is designed to control the throughflow through the bypass channel. Preferably, the bypass valve is pretensioned into a closed position in which the bypass channel is closed. Further preferably, the bypass valve is movable by a fluid pressure prevailing in the main channel from the closed position into an open position in which at least a portion of the first fluid flows through the bypass channel. In particular, it may be provided that the volumetric flow which is permitted to pass through the bypass channel by the bypass valve is dependent on a total volumetric flow of the first fluid entering the main channel. By means of the bypass valve according to the invention, it may thus be ensured that the volumetric flow of the first fluid is kept substantially constant by the narrowing. Preferred total volumetric flows which may be used within the context of the invention range between 2 l/min and 100 l/min, preferably between 6 l/min and 80 l/min, further preferably between 8 l/min and 50 l/min.

In a preferred embodiment, the return channel of the second fluid may also be designed to pass through a substantially constant volumetric flow. In particular, the return channel may be designed to pass through a volumetric flow which is substantially identical to the volumetric flow of the first fluid. To this end, the device according to the invention may have a corresponding return pump which is suitable for generating corresponding volumetric flows. A device may be provided for regulating the volumetric flow of the second fluid as a function of the volumetric flow of the first fluid, said device being able to be part of the device according to the invention or even part of a delivery nozzle according to the invention described further hereinafter or a delivery pump according to the invention described further hereinafter.

In a preferred embodiment, the device according to the invention further comprises a switch valve which is arranged in the return channel downstream of the test channel and which is switchable between an open position and a closed position, wherein the switch valve in the open position opens the return channel for returning the second fluid and in the closed position closes the return channel. Preferably the sensor is operatively connected to the switch valve, wherein the switch valve is switched as a function of the determined pressure. In this manner, by directly using the pressure determined by the sensor, the return may be switched off by closing the switch valve and/or switched on by opening the switch valve.

The device according to the invention is preferably used when filling a fuel into a tank. To this end, a delivery nozzle with an outflow tube is commonly used, wherein the delivery nozzle may be connected to a delivery pump. Within the meaning of the present invention, in principle, a main channel and a return channel may extend from the outflow tube via the delivery nozzle to the delivery pump. In principle, the features according to the invention may thus be arranged at any point in such a system consisting of the outflow tube, delivery nozzle and delivery pump.

Nevertheless, the features according to the invention permit a particularly compact design so that it is possible to integrate the features according to the invention in an outflow tube of a delivery nozzle. The subject of the invention, therefore, is also an outflow tube of a delivery nozzle which has a device according to the invention for discharging a first fluid and for returning a second fluid. The outflow tube according to the invention may be developed by further features which have been described within the context of the device according to the invention. If the features of the device according to the invention are implemented in an outflow tube, it is possible in the case of a delivery nozzle according to the prior art to exchange the outflow tube for an outflow tube according to the invention and to retrofit the delivery nozzle in this manner with the features according to the invention. A corresponding delivery nozzle which comprises such an outflow tube according to the invention is also the subject of the invention. Finally, a delivery pump which has a delivery nozzle according to the invention is also a subject of the present invention.

Further subjects of the invention are additionally a delivery nozzle which has the device according to the invention and a delivery pump which has a device according to the invention.

Figure 1B:
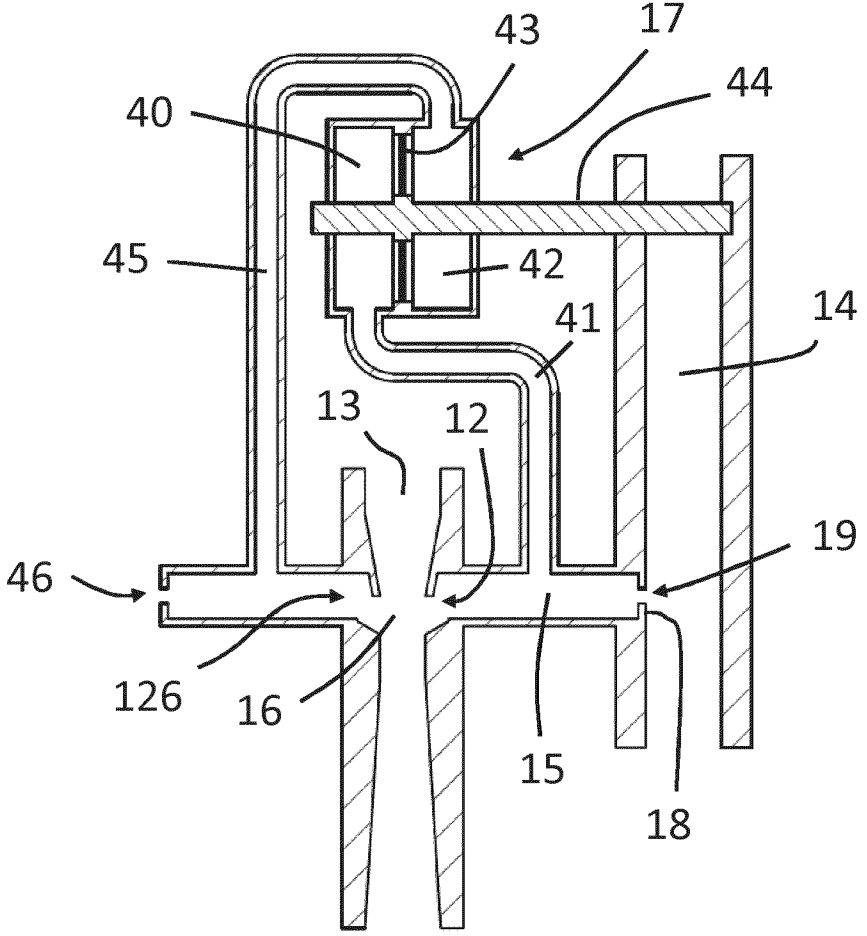
Figure 2A:
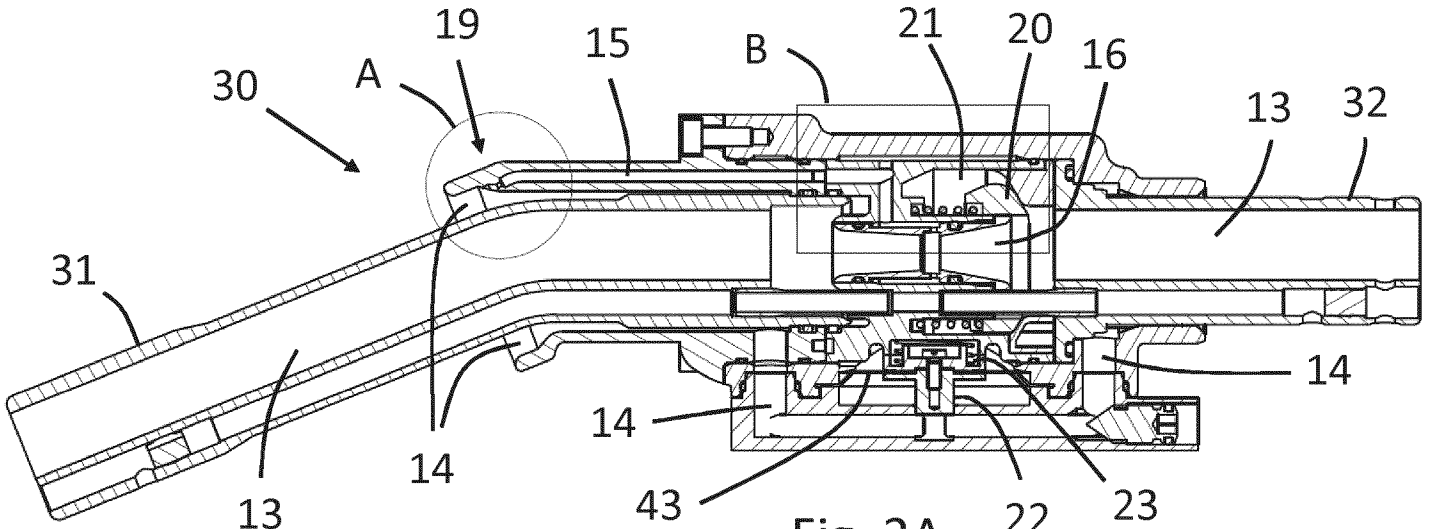
Figure 2C:
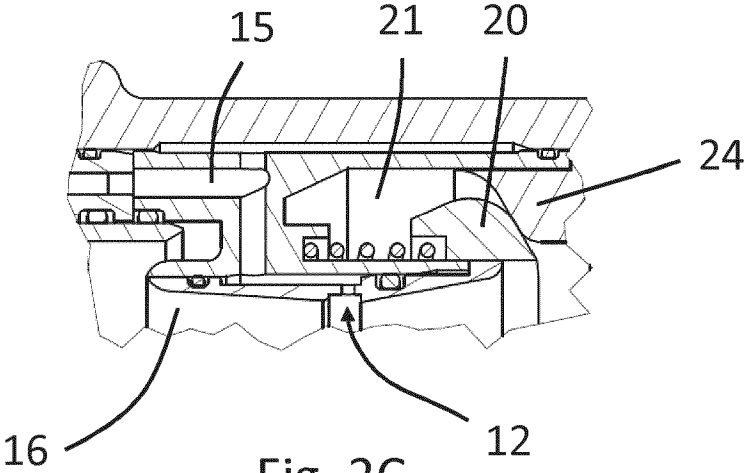
Figure 2B:
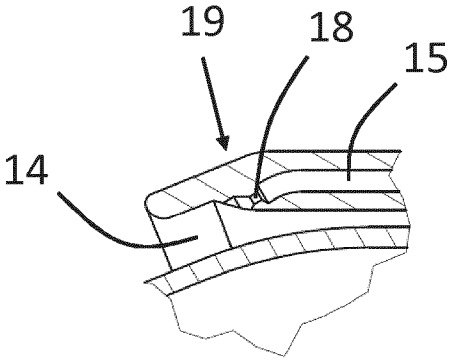
Figure 3A:
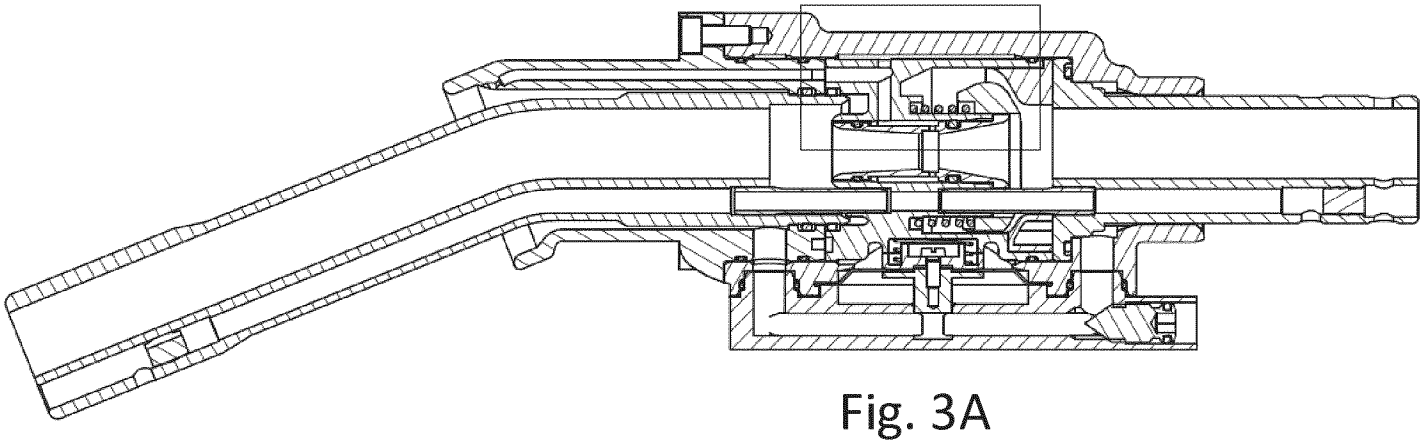
Figure 3B:
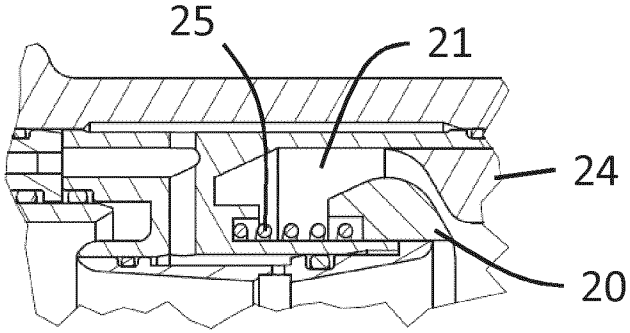
Figure 4A:
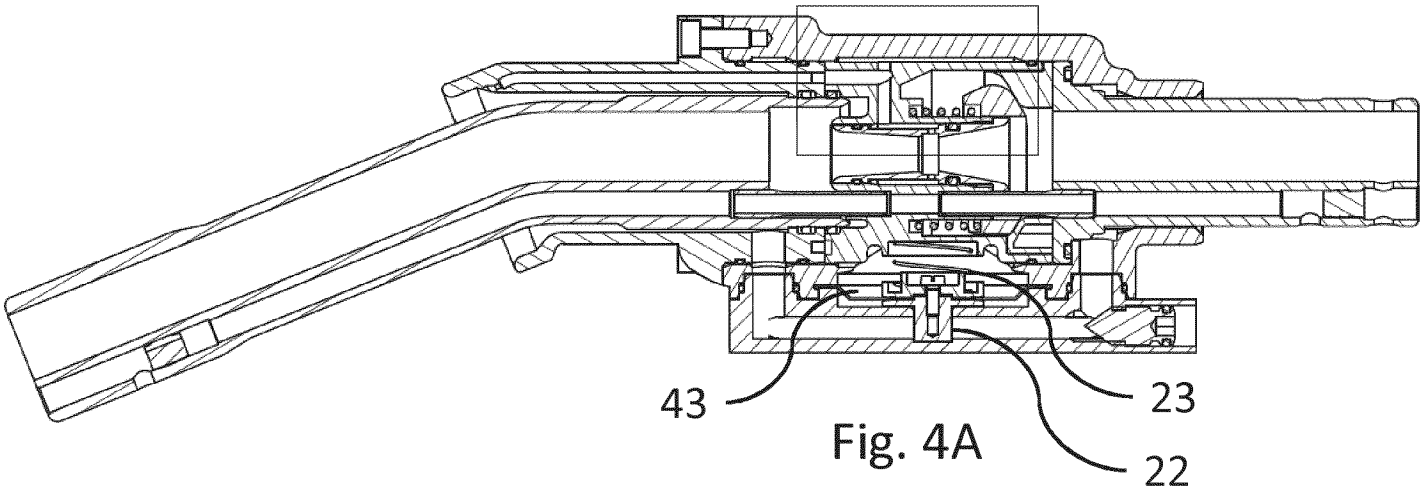
Figure 4B:
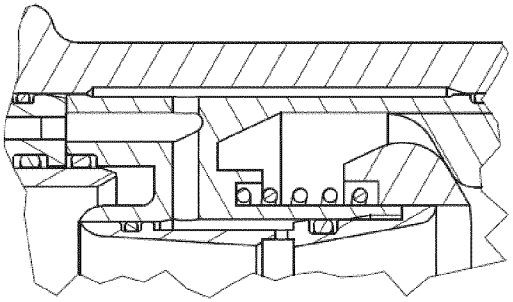

A preferred embodiment of the invention is described hereinafter by way of example with reference to the accompanying drawings, in which:

FIG. 1A: shows a schematic view of a device according to the invention for discharging a first fluid and for returning a second fluid;

FIG. 1B: shows a schematic view of an alternative embodiment of the device according to the invention for discharging a first fluid and for returning a second fluid;

FIG. 2A: shows a sectional view through an outflow tube according to the invention when discharging a first fluid at low volumetric flow and when returning a second fluid;

FIG. 2B: shows a detail of FIG. 2A in an enlarged view;

FIG. 2C: shows a detail of FIG. 2A in an enlarged view;

FIG. 3A: shows the sectional view of FIG. 2A when discharging a first fluid at high volumetric flow;

FIG. 3B: shows a detail of FIG. 3A in an enlarged view;

FIG. 4A: shows a sectional view through an outflow tube according to the invention when discharging a first fluid at low volumetric flow, wherein a return of a second fluid does not take place;

FIG. 4B: shows a detail of FIG. 4A in an enlarged view.

An embodiment according to the invention shown in FIG. 1A of a device for discharging a first fluid and for returning a second fluid comprises a main channel 13 which is designed to pass through the first fluid, for example a liquid fuel. To this end the main channel 13 may be connected to a fuel reservoir, not shown, fuel being pumped therefrom by means of a fuel pump through the main channel 13. The main channel 13 comprises a narrowing 16.

The device further comprises a return channel 14 through which a second fluid, for example a gas and, in particular, fuel vapors, air or a mixture of fuel vapors and air may be passed. To this end, the return channel 14 may also be connected to a fuel reservoir, not shown, wherein the second fluid is pumped off via a return pump into the fuel reservoir.

Between the main channel 13 and the return channel 14 extends a test channel 15 which feeds in the region of a first opening 12 into the main channel 13 and in the region of a second opening 19 into the return channel 14.

The first opening 12 is arranged in the region of the narrowing 16. A flow resistance 18 is located in the region of the second opening 19, said flow resistance constituting an orifice within the meaning of the present invention. The flow resistance 18 limits the flow cross section which is available for the transition into the test channel 14. The test channel 14 is also connected to a pressure sensor 17 which is designed to determine a fluid pressure in the test channel 15.

If a fuel is pumped through the main channel 13, the Venturi effect causes a drop in the hydrostatic pressure in the region of the narrowing 16. Gas which is located in the return channel 14 is suctioned by the negative pressure into the test channel 15. In this case, when entering the test channel a pressure difference, which is dependent on the physical material properties of the suctioned gas, is produced at the flow resistance. In this manner, using the determined pressure value it may be established whether the suctioned gas is air or fuel vapors.

FIG. 1B shows an alternative embodiment of the device according to the invention for discharging a first fluid and for returning a second fluid. Essential elements of this embodiment are identical to those of FIG. 1A and are provided with the same reference numerals.

In contrast to the embodiment of FIG. 1A a further feed opening 126, which is connected via a reference opening 46 to the ambient air, is arranged in the region of the narrowing 16. If a fuel is pumped through the main channel 13, therefore, external air is suctioned in via the reference opening 46.

In the embodiment of FIG. 1B the pressure sensor 17 additionally has a test chamber 40 which is fluidically connected to the test channel 15 via a test line 41. The sensor 17 also comprises a reference chamber 42 which is connected to the reference opening 46 via a reference line 45. Finally, the sensor has a pressure-sensitive membrane 43 which separates the test chamber 40 from the reference chamber 42.

The membrane 43 is connected via a trigger mechanism, not shown, to a plunger 44. The membrane 43 is designed to actuate the trigger mechanism as a function of a pressure difference between the test chamber 40 and the reference chamber 42 and thus the plunger 44 is moved from an open position in which the return channel 14 is open (not shown) into the closed position shown in FIG. 1B in which the return channel is closed. To this end, the plunger 44 is moved by the trigger mechanism.

As long as fuel vapors are guided through the return line 14, the pressure inside the test chamber 40 remains at a value at which the plunger 44 remains in the open position. If greater quantities of air are guided through the return channel 14, the pressure increases in the test chamber 40. As soon as a certain pressure threshold value is exceeded, the membrane 43 is moved and as a result triggers the trigger mechanism by which the plunger 44 is moved into the closed position shown in FIG. 2.

FIG. 2A shows a cross-sectional view through an outflow tube 30 according to the invention for discharging a fuel and for returning a gas, wherein the fuel is discharged at a low volumetric flow. The elements according to the invention which have been already described in connection with FIGS. 1A and 1B bear the same reference numerals in FIG. 2A and are not described in further detail hereinafter. Illustrated in FIG. 2A are a circular detail A and a rectangular detail B which are shown enlarged in FIGS. 2B and/or 2C.

The outflow tube 30 has a front end 31 and a rear end 32. The front end 31 may be introduced, for example, into a filler neck of a vehicle tank for discharging a fuel (not shown). The rear end 32 may be introduced into a delivery nozzle, not shown. Instead of the plunger 44 the outflow tube according to the invention comprises a switch valve 22 which is connected to a trigger mechanism 23. The pressure sensor 17 has in the embodiment of FIG. 2A, as well as the embodiment of FIG. 1B, a pressure-sensitive membrane 43 which is operatively connected to the trigger mechanism 23. The outflow tube further comprises a bypass channel 21 and a bypass valve 20. The bypass valve 20 is pretensioned by a restoring device 25 into a closed position in which it bears against a valve seat 24.

In the state shown in FIG. 2A a fuel is passed at a low volumetric flow of approximately 10 l/min through the main channel 13. The low volumetric flow in the main channel 13 is not able to open the bypass valve 20 against a closing force of the restoring device 25 so that the bypass valve 20 remains in its closed position. This may be seen, in particular, in FIG. 2C in which it may be identified that the bypass valve 20 bears against an associated valve seat 24 and the bypass channel 21 is closed. The volumetric flow flowing through the main channel 13 is therefore passed entirely through the narrowing 16. In the case of an increase of the volumetric flow through the main channel 13 (for example to up to 50 l/min), the bypass valve 20 is displaced by the fluid pressure from the closed position into an open position so that a portion of the volumetric flow may flow past the narrowing 16 through the bypass channel 21. This is illustrated in FIGS. 3A and 3B which also coincide with FIGS. 2A and 2C. The greater the volumetric flow through the main channel 13, the wider the bypass valve opens. By means of the narrowing 16 the volumetric flow may thus be kept constant at approximately 10 l/min so that the test channel 15 is evacuated at a constant suction power.

Moreover, in the state shown in FIG. 2A fuel vapors are removed via the return channel 14. The fuel vapors are ideally removed at the same volumetric flow at which the fuel is guided through the main channel 13 so that there is a constant ratio of fuel to fuel vapors. As already described with reference to FIG. 1A, a negative pressure is generated when the fuel passes through the main channel 13 in the test channel 15, which leads to a suctioning of the fuel vapors located in the return channel 14. The volumetric flow of the fuel vapors suctioned through the test channel 15 is mixed with the volumetric flow of fuel in the main channel 13 and is negligibly small relative thereto.

The space above the membrane 43 corresponds to the test chamber 40 shown in FIG. 1B but for reasons of space is not provided with a reference numeral. The test chamber is connected to the test channel 15, wherein this connection is not identifiable in the sectional view shown. The pressure prevailing in the test channel 15 acts directly on the membrane 43. The space below the membrane corresponds to the reference chamber 42 shown in FIG. 1B. The reference chamber is connected—also as shown in FIG. 1B—via the reference line 45 to the reference opening 46, wherein this is not identifiable in FIGS. 2A-4B. The further feed opening 126 is also not identifiable in FIGS. 2A-4B.

The membrane 43 is operatively connected to the switch valve 22, via the trigger mechanism 23 which in the embodiment shown is pretensioned by way of example by a spring. In alternative embodiments, the trigger mechanism may also be pressurized or subjected to a magnetic force. In the operating conditions shown in FIG. 2A (when suctioning fuel vapors) a negative pressure of approximately −0.060 bar prevails in the test chamber relative to the reference chamber. This negative pressure is below a pressure threshold value (which for example may be −0.050 bar) in which the membrane 43 moves and triggers the trigger mechanism 23. The switch valve 22 thus remains in the open state shown, in which the fuel gases are removed via the return channel 14.

If the vehicle to be refueled is a vehicle with an ORVR system, air is substantially removed via the return channel 15. The different physical material properties of the removed air, relative to the fuel vapors, lead to a pressure increase in the test channel 15 and thus also in the test chamber so that the negative pressure relative to the reference chamber is still only approximately −0.045 bar. When removing air, therefore, the pressure threshold value is exceeded by −0.050 bar in which the membrane 43 is moved and triggers the trigger mechanism 23. In this case, the switch valve 22 is switched into the closed position by the trigger mechanism. This state is shown in FIGS. 4A and 4B which generally coincide with FIGS. 2A and 2C. In the state shown in FIG. 4A, the gas return is thus prevented by the switch valve 22.

The invention claimed is:

1. A device for discharging a first fluid and for returning a second fluid, comprising a main channel (13) for discharging the first fluid and a return channel (14) for returning the second fluid, wherein the main channel (13) has a narrowing (16), characterized by a test channel (15) which connects the main channel (13) to the return channel (14), wherein the test channel (15) issues into the main channel (13) in the region of the narrowing (16), wherein the device further has a sensor (17) which is designed to determine a pressure in the test channel (15).

2. The delivery nozzle, characterized in that it has a device as claimed in claim 1.

3. A delivery pump, characterized in that it has a device as claimed in claim 1.

4. The device as claimed in claim 1, wherein the test channel (15) has a orifice (18).

5. The device as claimed in claim 4, wherein the sensor (17) is designed to determine the pressure downstream of the orifice (18).

6. The device as claimed in claim 1, which further has a switch valve (22) which is arranged in the return channel (14) downstream of the test channel (15) and which is switchable between an open position, in which the switch valve (22) opens the return channel (14) for returning the second fluid, and a closed position in which the switch valve (22) closes the return channel.

7. The device as claimed in claim 6, wherein the sensor (17) is operatively connected to the switch valve (21), wherein the switch valve (22) is switched as a function of the determined pressure.

8. The device as claimed in claim 1, wherein the return channel (14) is designed to pass through a volumetric flow which is substantially identical to the volumetric flow of the first fluid.

9. The device as claimed in claim 8, wherein the volumetric flow through the return channel (14) is between 5 l/min and 100 l/min.

10. The device of claim 9, wherein the volumetric flow through the return channel (14) is between 10 l/min and 50 l/min.

11. An outflow tube of a delivery nozzle, characterized in that it has a device as claimed claim 1.

12. A delivery nozzle comprising an outflow tube as claimed in claim 11.

13. The delivery pump comprising a delivery nozzle as claimed in claim 12.

14. The device as claimed in claim 1, wherein the main channel (13) is designed to pass a substantially constant volumetric flow through the narrowing (16).

15. The device as claimed in claim 14, wherein the main channel (13) has a bypass channel (21) bridging the narrowing (16), wherein a bypass valve is provided for controlling the throughflow through the bypass channel (21).

16. The device as claimed in claim 15, wherein the bypass valve (20) is pretensioned into a closed position in which the bypass channel (21) is closed, wherein the bypass valve (20) is movable by a fluid pressure prevailing in the main channel (13) from the closed position into an open position in which at least a portion of the first fluid flows through the bypass channel (21).

17. The device as claimed in claim 15, wherein the volumetric flow which is permitted to pass through the bypass channel (21) by the bypass valve (20) is dependent on a total volumetric flow of the first fluid entering the main channel.

18. The device as claimed in claim 14, wherein the volumetric flow through the narrowing is between 2 l/min and 20 l/m.

19. The device as claimed in claim 18, wherein the volumetric flow through the narrowing is between 5 l/min and 15 l/min.

20. The device as claimed in claim 19, wherein the volumetric flow through the narrowing is between 8 l/min and 12 l/min.

* * * * *